US005564563A

United States Patent [19]

Focke et al.

[11] Patent Number: 5,564,563

[45] Date of Patent: Oct. 15, 1996

[54] CIGARETTE PACK WITH LID

[75] Inventors: Heinz Focke, Verden; Henry Buse, Vissel-Hövede, both of Germany

[73] Assignee: Focke & Co. (GmbH & Co.), Verden, Germany

[21] Appl. No.: 339,744

[22] Filed: Nov. 14, 1994

[30] Foreign Application Priority Data

Nov. 15, 1993 [DE] Germany ..... 43 38 954.6

[51] Int. Cl.[6] ..... B65D 85/10

[52] U.S. Cl. ..... 206/268; 206/271

[58] Field of Search ..... 206/242, 246, 206/247, 250, 256–276

[56] References Cited

U.S. PATENT DOCUMENTS

| | | | |
|---|---|---|---|
| 1,437,157 | 11/1922 | Fazio | 206/266 |
| 1,525,860 | 2/1925 | Flynn | 206/269 |
| 1,587,468 | 6/1926 | Burkey et al. | 206/269 |
| 2,227,158 | 12/1940 | Saul . | |
| 2,361,984 | 11/1944 | Williamson | 206/273 |
| 4,207,976 | 6/1980 | Herman | 206/268 |
| 4,989,728 | 2/1991 | Neyret et al. . | |
| 5,074,412 | 12/1991 | White | 206/268 |

FOREIGN PATENT DOCUMENTS

| | | | |
|---|---|---|---|
| 443365 | 2/1991 | European Pat. Off. . | |
| 1069063 | 11/1959 | Germany | 206/268 |
| 8002488 | 1/1980 | Germany . | |
| 8611201 | 9/1987 | Germany . | |
| 3613780 | 11/1987 | Germany | 206/268 |
| 8803726 | 8/1989 | Germany . | |
| 518117 | 12/1974 | U.S.S.R. . | |
| 731887 | 4/1980 | U.S.S.R. . | |
| 1223836 | 12/1981 | U.S.S.R. . | |

*Primary Examiner*—Jimmy G. Foster

*Attorney, Agent, or Firm*—Sughrue, Mion, Zinn, Macpeak & Seas

[57] ABSTRACT

The invention relates to a cigarette pack, in particular a hinge-lid box, for cigarettes (10). A cigarette (10) or a part-cigarette (33) is intended to be accommodated temporarily in the cigarette pack. For this purpose, the length of the cigarettes (10) is smaller than the height or length of the cigarette pack, such that, when the cigarette pack is closed, a cavity (chamber 31) for receiving at least one transversely arranged cigarette (10) or part-cigarette (33) is formed above the cigarette group (28) or the cigarette block (30), in the interior of the lid (12).

3 Claims, 3 Drawing Sheets

Fig. 2
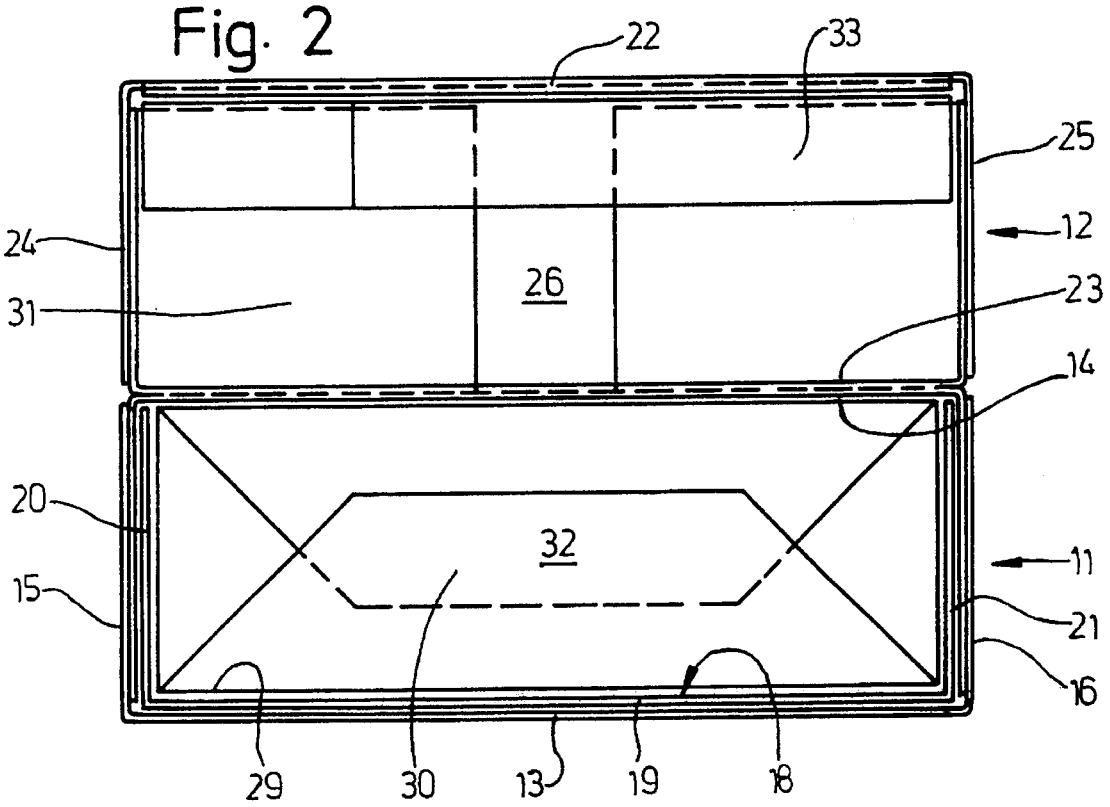
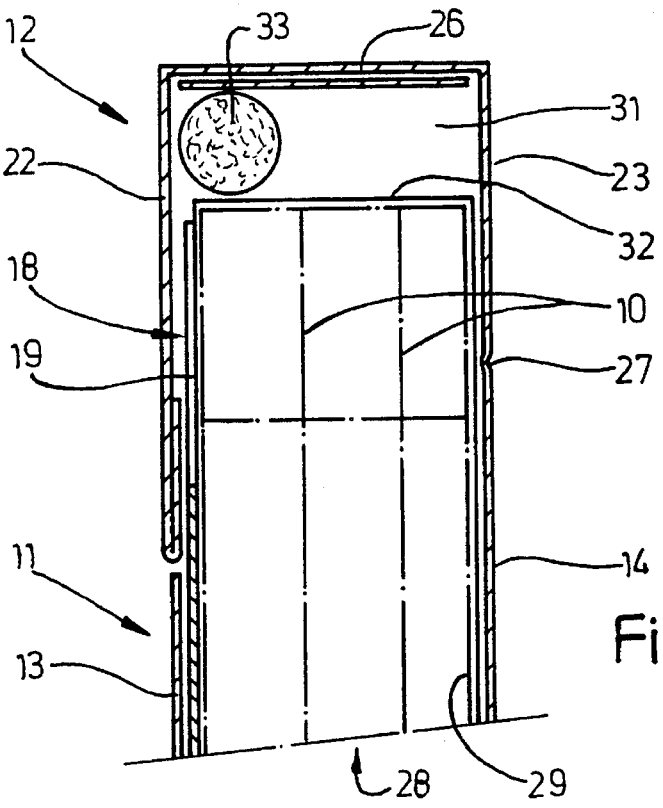
Fig. 3

Fig. 4
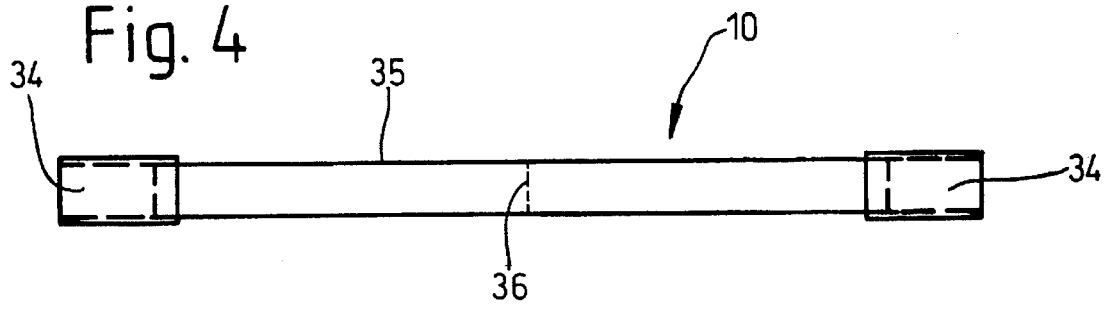
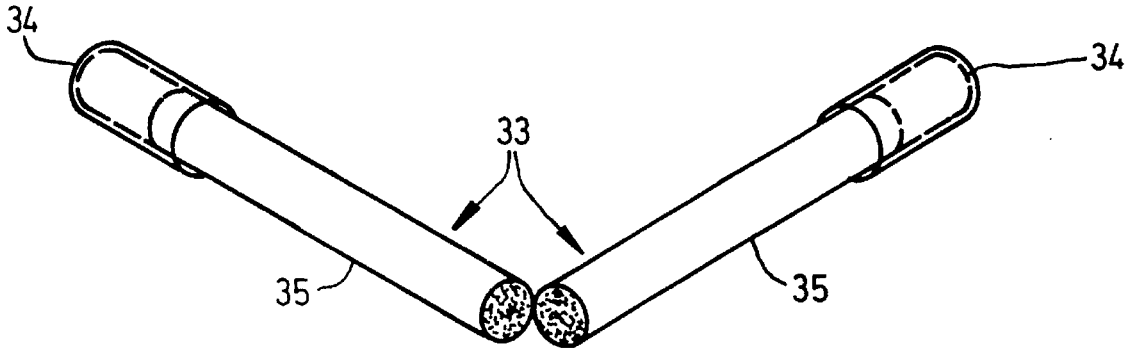
Fig. 5

CIGARETTE PACK WITH LID

BACKGROUND OF THE INVENTION

The invention relates to a cigarette pack with lid, in particular hinge-lid box, with a box part for receiving a cigarette group, in particular for dividable cigarettes.

The invention is mainly concerned with the development of hinge-lid boxes (hinge-lid packs), a type of pack for cigarettes which is extremely well known throughout the world. This type of pack is conventionally made up so that a cigarette group is wrapped in an inner blank consisting of paper or tin foil and forms a cigarette block as pack contents. The cigarette block is positioned in the box part of the hinge-lid box. A lid is pivotably connected to a rear wall of the box part. The invention is concerned with a novel configuration of these packs or of similar packs. In particular, the aim is to provide additional possible usages for such packs.

SUMMARY OF THE INVENTION

The object of the invention is further to develop cigarette packs of the type mentioned in the introduction to the effect that part-cigarettes can be accommodated in the pack for temporary storage.

In order to achieve this object, the cigarette pack according to the invention is characterized in that the length of the cigarettes is smaller than the height or length of the cigarette pack, such that, when the cigarette pack is closed, a cavity for receiving at least one transversely arranged cigarette or part-cigarette is formed above the cigarette group or the cigarette block, in the interior of the lid.

The cigarette pack according to the invention accordingly exhibits a cavity which is not filled by the pack contents, that is to say by the cigarette block, and which serves to position at least one cigarette or a part-cigarette of relatively short length.

The invention can be used particularly advantageously in the case of dividable cigarettes, of which in each case only one part-cigarette is smoked, and the other part-cigarette can be stored until it is required. Such cigarettes are designed such that they can be divided preferably in the centre, in doing so forming two part-cigarettes which can be smoked independently. In the case of the cigarette pack according to the invention, the (part-) cigarette which is to be stored until it is used at a later date is accommodated in the cavity formed in the lid of the pack.

The cigarette pack and the cigarettes or part-cigarettes are coordinated with respect to one another according to the invention, in terms of their dimensions, such that the (part-) cigarette which is to be stored can be fitted in the cavity formed in the lid and is fixed there with a certain clamping action.

Further details of the invention are illustrated in more detail hereinbelow, with reference to an exemplary embodiment, of the cigarette pack and of a cigarette, which is represented in the drawings, in which:

BRIEF DESCRIPTION OF THE DRAWINGS

FIG. 2 shows, on a vastly enlarged scale, a plan view of the cigarette pack according to FIG. 1 in the open position, FIG. 3 shows, on an enlarged scale, the upper region of the cigarette pack in the vertical section III—III of FIG. 1, FIG. 4 shows a side view of a dividable cigarette, and FIG. 5 shows a perspective representation of the dividable cigarette according to FIG. 4, with two part-cigarettes.

DESCRIPTION OF A PREFERRED EMBODIMENT

Figure 1:
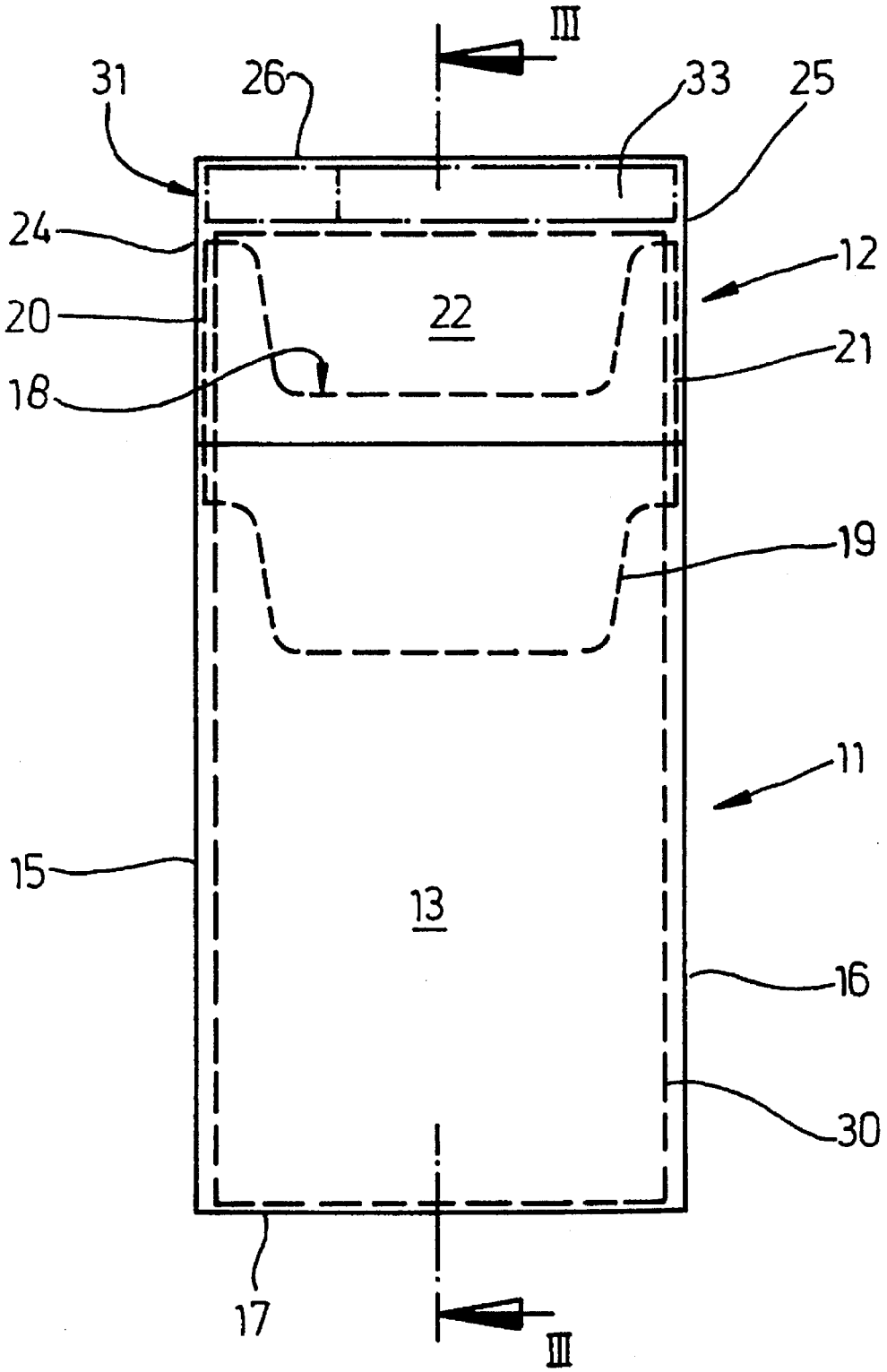
FIG. 1 shows a front view of a cigarette pack of the hinge-lid-box type.

The exemplary embodiment represented in the drawings is concerned with a hinge-lid box for cigarettes 10 which is conventional in terms of the basic design features. Such a hinge-lid box is composed of a (lower) box part 11 and of a lid 12. The box part 11 is composed of the front wall 13, rear wall 14, side walls 15 and 16 and of a base wall 17. Located within the box part 11 is a collar 18 with a collar front wall 19 and collar side walls 20, 21. The collar is located within the box part 11 by means of a lower sub-region. In the closed position of the cigarette pack, an upper sub-region projecting out of said box part is enclosed by the lid 12.

The lid 12 is composed of lid front wall 22, lid rear wall 23, lid side walls 24, 25 and of a lid upper wall 26. Via an articulation line 27, the lid rear wall 23 is pivotably connected to the rear wall 14 of the box part 11. In the closed position (FIG. 1, FIG. 3), the lid 12, which is designed in this manner, encloses an upper part, projecting out of the box part 11, of the pack contents and of the collar 18.

The pack contents are constituted by a group of cigarettes 10, that is to say a cigarette group 28. The latter is enclosed on all sides by an inner wrapping 29 consisting of paper or tin foil. A cigarette block 30 is thus obtained.

The cigarette block 30 completely fills the cross-section of the cigarette pack or of the box part 11. Conventionally, a cigarette pack of this type is geared towards a three-row formation of the cigarettes 10, the cigarettes 10 of the central row being located in a manner offset with respect to the cigarettes 10 of the two outer rows.

Due to a corresponding length of the cigarettes 10, the height of the cigarette block 30 is smaller than the height of the cigarette pack or of the interior of the same. When the cigarette pack is closed, this thus results in a cavity or a chamber 31 in the upper region of the cigarette pack, namely in the lid 12. The chamber 31 is accordingly delimited by an upper end wall 32 of the cigarette block 30 and by the walls of the lid 12.

The chamber 31 serves for the (temporary) accommodation of at least one cigarette or part-cigarette 33.

The cigarette or part-cigarette 33 is located within the chamber 31 with its axis transverse with respect to the cigarettes 10 of the cigarette group 28. In the case of the exemplary embodiment shown, the chamber 31 is dimensioned such that its height corresponds approximately to the diameter of a cigarette or part-cigarette 33. The length of the chamber 31, namely the extent from one lid side wall 24 to the other lid side wall 25, corresponds, in the present case, to the length of the cigarette or part-cigarette 33 which is to be accommodated. Preferably, the dimensions are coordinated with respect to one another such that the part-cigarette 33 is retained in the chamber with a certain clamping action such that it is supported on the inner side of the lid side walls 24, 25. When the cigarette pack is open, the part-cigarette 33 is introduced into the lid 12 and, likewise when the cigarette pack is open, can be removed again from the chamber 31.

The cigarettes 10 are designed as "double cigarettes" such that they can be divided—centrally in the present case—this resulting in two part-cigarettes 33. For this purpose, the cigarette 10 is provided at both ends with in each case one conventional filter piece 34. Cigarette paper 35 extends over the full length of the cigarette 10. Dividing the cigarette 10 results in two part-cigarettes 33 which can be used independently, each having a filter piece 34. The cigarette paper 35 is provided, in the longitudinal centre of the cigarette 10, with a weakened line, in particular perforation 36, in order to make it easy to divide. The cigarette 10 may also be differently designed, for example with a central double filter which can be divided in order to form two part-cigarettes 33.

In the case of a preferred embodiment, the cigarette pack and its contents may exhibit the following dimensions: the cigarette pack itself has a width of 56 mm, a depth of 23 mm and a height of 121 mm. The diameter of the cigarette 10 is 8 mm. The length of the cigarettes 10 is fixed at 112 mm. This means that the height of the chamber 31 is approximately 8 mm (clear internal dimension). When a cigarette 10 of the above dimensions is divided in the centre, the cigarette or part-cigarette 33 which is to be accommodated in this chamber 31 has a length of 56 mm. This dimension corresponds to the width of the pack, with the result that—taking into account the material thicknesses—the part-cigarette 33 is retained in the lid 12 with a slight clamping action.

The hinge-lid box can also be designed, and coordinated, in terms of the dimensions, with respect to the cigarettes 10 or part-cigarettes 33, such that the cigarette or part-cigarette is not positioned in an exact transverse manner, parallel to the lid front wall 22 and lid rear wall 23, but is positioned diagonally from one corner or inner edge of the lid 12 to the diagonally opposite inner edge of the lid.

We claim:

1. A hinge-lid box having a cuboidal shape and containing cigarette group, said box comprising a box part (11) and an upper lid (12) which is pivotably connected to a rear wall (14) of the box part (11), the cigarette group (28) being disposed within the box part (11) and having an upper part which projects from the box part (11), wherein:

a) the cigarette group (28) comprises a plurality of cigarettes (10) each of which is dividable into two part-cigarettes (33) which are independently smokeable;

b) in a closed position of the hinge-lid box, a normally empty cavity (31) is formed within said lid (12), above said cigarette group (28);

c) in said closed position, the cavity (31) has a height that corresponds approximately to the diameter of a cigarette (10);

d) said cavity has a length defined by oppositely disposed lid side walls (24, 25) which are separated by a longitudinal distance corresponding to the length of a part-cigarette, such that d1) either a part-cigarette is positionable, by way of fixedly clamping it between the lid side walls (24, 25) in the lid (12) in the longitudinal direction of the lid and, thus, parallel to said rear wall (14) of said box part (11), d2) or a part-cigarette is positionable, by way of fixedly clamping it between the lid side walls (24, 25) and an adjoining lid front wall (22) or adjoining lid rear wall (23) in the lid (12) in a diagonal position relative to said longitudinal direction; and each of the cigarettes (10) is provided, at both ends thereof, with a filter (34), such that, when a cigarette (10) is divided, two filter cigarettes are obtained, and wherein one of the two filter cigarettes is positionable in the cavity (31) by way of clamping.

2. A hinge-lid box having a cuboidal shape and containing a cigarette group, said box comprising a box part (11) and an upper lid (12) which is pivotably connected to a rear wall (14) of the box part (11), the cigarette group (28) being disposed within the box part (11) and having an upper part which projects from the box part (11), wherein:

a) the cigarette group (28) comprises a plurality of cigarettes (10) each of which is dividable into two part-cigarettes (33) which are independently smokeable;

b) in a closed position of the hinge-lid box, a normally empty cavity (31) is formed within said lid (12), above said cigarette group (28);

c) in said closed position, the cavity (31) has a height that corresponds approximately to the diameter of a cigarette (10);

d) said cavity has a length defined by oppositely disposed lid side walls (24, 25) which are separated by a longitudinal distance corresponding to the length of a part-cigarette, such that d1) either a part-cigarette is positionable, by way of fixedly clamping it between the lid side walls (24, 25) in the lid (12) in the longitudinal direction of the lid and, thus, parallel to said rear wall (14) of said box part (11), d2) or a part-cigarette is positionable, by way of fixedly clamping it between the lid side walls (24, 25) and an adjoining lid front wall (22) or adjoining lid rear wall (23) in the lid (12) in a diagonal position relative to said longitudinal direction; and each of the cigarettes (10) is centrally provided with a weakened line (36).

3. A hinge-lid box having a cuboidal shape and containing a cigarette group, said box comprising a box part (11) and an upper lid (12) which is pivotably connected to a rear wall (14) of the box part (11) the cigarette group (28) being disposed within the box part (11), and having an upper part which projects from the box part (11), wherein:

a) the cigarette group (28) comprises a plurality of cigarettes (10) each of which is dividable into two part-cigarettes (33) which are independently smokeable;

b) in a closed position of the hinge-lid box, a normally empty cavity (31) is formed within said lid (12), above said cigarette group (28);

c) in said closed position, the cavity (31) has a height that corresponds approximately to the diameter of a cigarette (10);

d) said cavity has a length defined by oppositely disposed lid side walls (24, 25) which are separated by a longitudinal distance corresponding to the length of a part-cigarette, such that d1) either a part:cigarette is positionable, by way of fixedly clamping it between the lid side walls (24, 25) in the lid (12) in the longitudinal direction of the lid and, thus, parallel to said rear wall (14) of said box part (11), d2) or a part-cigarette is positionable, by way of fixedly clamping it between the lid side walls (24, 25) and an adjoining lid front wall (22) or adjoining lid rear wall (23) in the lid (12) in a diagonal position relative to said longitudinal direction; and each of the cigarettes (10) is provided with a central double-filter which is dividable in order to form the two part-cigarettes (33), such that two filter cigarettes are formed upon the division of a cigarette, and wherein one of the two filter cigarettes is accommodated in the cavity (31).

* * * * *